United States Patent [19]

Bassill

[11] Patent Number: 4,850,387

[45] Date of Patent: Jul. 25, 1989

[54] LIQUID DISPENSING VALVE

[76] Inventor: Nicholas Bassill, 3085 Motor Ave., Los Angeles, Calif. 90064

[21] Appl. No.: 132,961

[22] Filed: Dec. 15, 1987

[51] Int. Cl.[4] ..... B65D 83/14

[52] U.S. Cl. ..... 137/212; 222/400.7; 137/614

[58] Field of Search ..... 137/212, 614; 222/400.7; 285/317

[56] References Cited

U.S. PATENT DOCUMENTS

| | | | |
|---|---|---|---|
| 587,987 | 8/1897 | Mills | 222/400.7 |
| 1,056,394 | 3/1913 | Bernard | 137/212 X |
| 2,189,643 | 2/1940 | Ward | 137/212 X |
| 4,541,457 | 9/1985 | Blenkush | 285/317 X |

*Primary Examiner*—Alan Cohan

*Attorney, Agent, or Firm*—Blakely, Sokoloff, Taylor, Zafman

[57] ABSTRACT

A valve for controllably admitting a pressurized gas into a bottle and dispensing a liquid from the bottle. The valve attaches to the top of an opened bottle and includes a valve body having a liquid section and a gas section. An intake tube descends from the valve body into the bottle and communicates with a liquid outlet spout through the liquid section of the valve body. Gas from a source of pressurized gas is controllably admitted through the valve body into the neck of the bottle to force the liquid within the bottle up the intake tube and into the liquid section of the valve body. A finger actuated trigger operates against a valve slide to selectively control opening and closing of the liquid and gas sections of the valve body. Valving is arranged so that communication between the liquid inlet and liquid outlet is always established before gas is admitted into the bottle and is maintained until after the gas supply is closed. This assures that excess gas pressure cannot accumulate within the bottle and that the liquid is exposed to a minimum pressure. The dispensing valve also includes a quick disconnect coupling so that the supply of pressurized gas may be conveniently disconnected from the dispensing valve while maintaining a sealed air-free atmosphere within the bottle.

6 Claims, 4 Drawing Sheets

10
2
40
20
22
12
14
16
18
AA
BB
25a
25b
25c
23
24
52
30
32
29
17
34
36
15
26
27
28
62
64
66
66a
68
60
72
70
76
74
48a
48b
48c
50
44
46
41
40
13

LIQUID DISPENSING VALVE

FIELD OF THE INVENTION

This invention relates to a valve for selectively controlling the flow of a liquid and a gas, and particularly to a valve adapted for dispensing a liquid such as wine from a bottle.

PRIOR ART

Fine wines are typically bottled in one liter or 750 ml bottles. These quantities correspond to approximately six to ten glasses. A problem frequently encountered by connoisseurs of fine wines is storage of wine remaining from a bottle which has been only partially consumed. Once a bottle has been opened and the wine within has been exposed to air, it begins to oxidize and "turn" within hours. Consequently, wine remaining in a partially consumed bottle may be wasted or a bottle of wine may not be opened if consumption of less than the full bottle is contemplated.

It is known that wine may be preserved after a bottle is partially consumed if oxygen can be prevented from contacting the remaining wine. One way of achieving this is to replace the air in an opened bottle with an inert gas such as nitrogen. Systems for thus preserving opened bottles of wine have been available for use in restaurants and other institutions. Such systems, however, are not practical for use in the home.

The present invention provides a compact and inexpensive device for introducing a pressurized inert gas into an opened bottle of wine to partially dispense the contents and prevent oxidation of the remaining wine.

SUMMARY OF THE INVENTION

The present invention provides a bottle seal and valve assembly for dispensing wine from a bottle and for preserving the wine remaining in a partially consumed bottle. The valve assembly includes a liquid section and a gas section. A finger actuated trigger operates a valve slide to control the flow of wine through the liquid section of the valve and to control the flow of an inert gas from a pressurized dispenser into the bottle. The liquid and gas sections of the valve are sequentially activated so that the liquid section opens first and closes last. This assures that liquid is always allowed to flow while gas is admitted into the bottle, thereby precluding a build up of excess gas pressure within the bottle. In addition, wine in the bottle is subjected to a minimum gas pressure. Before the liquid line is shut off, the gas line is shut off, thereby the gas pressure in the bottle drops as more liquid is dispensed until the actual liquid line is closed by full release of the dispensing handle.

Air is prevented from entering the bottle by means of an elastomeric seal disposed within the neck of the bottle. The seal surrounds a tubular extension of the valve assembly that extends downwardly into the neck of the bottle. The seal is retained between a rigid washer at the lower end of the tubular extension and a bottle cap which rests on the mouth of the bottle. Actuation of a lever disposed on the top of the valve assembly acts against the bottle cap and compresses the elastomeric seal causing it to expand against the inner surface of the bottle neck.

The invention also comprises a quick disconnect coupling for attaching a source of pressurized gas to the valve assembly. A female section of the coupling is attached to the valve assembly and includes a positive seal for preventing the escape of gas from, and the entry of air into, the bottle when the male and female sections are uncoupled. A bottle may thus be disconnected from the source of gas and stored for an extended period of time while preserving an oxygen free atmosphere within the bottle.

DETAILED DESCRIPTION OF THE EMBODIMENTS

A device for dispensing wine from a bottle and for introducing a pressurized inert gas into the vacated space of the bottle is disclosed. In the following description, for purposes of explanation and not limitation, specific numbers, dimensions, materials, etc. are set forth in order to provide a thorough understanding of the present invention. However, it will be apparent to one skilled in the art that the present invention may be practiced without these specific details.

Figures 1, 2:
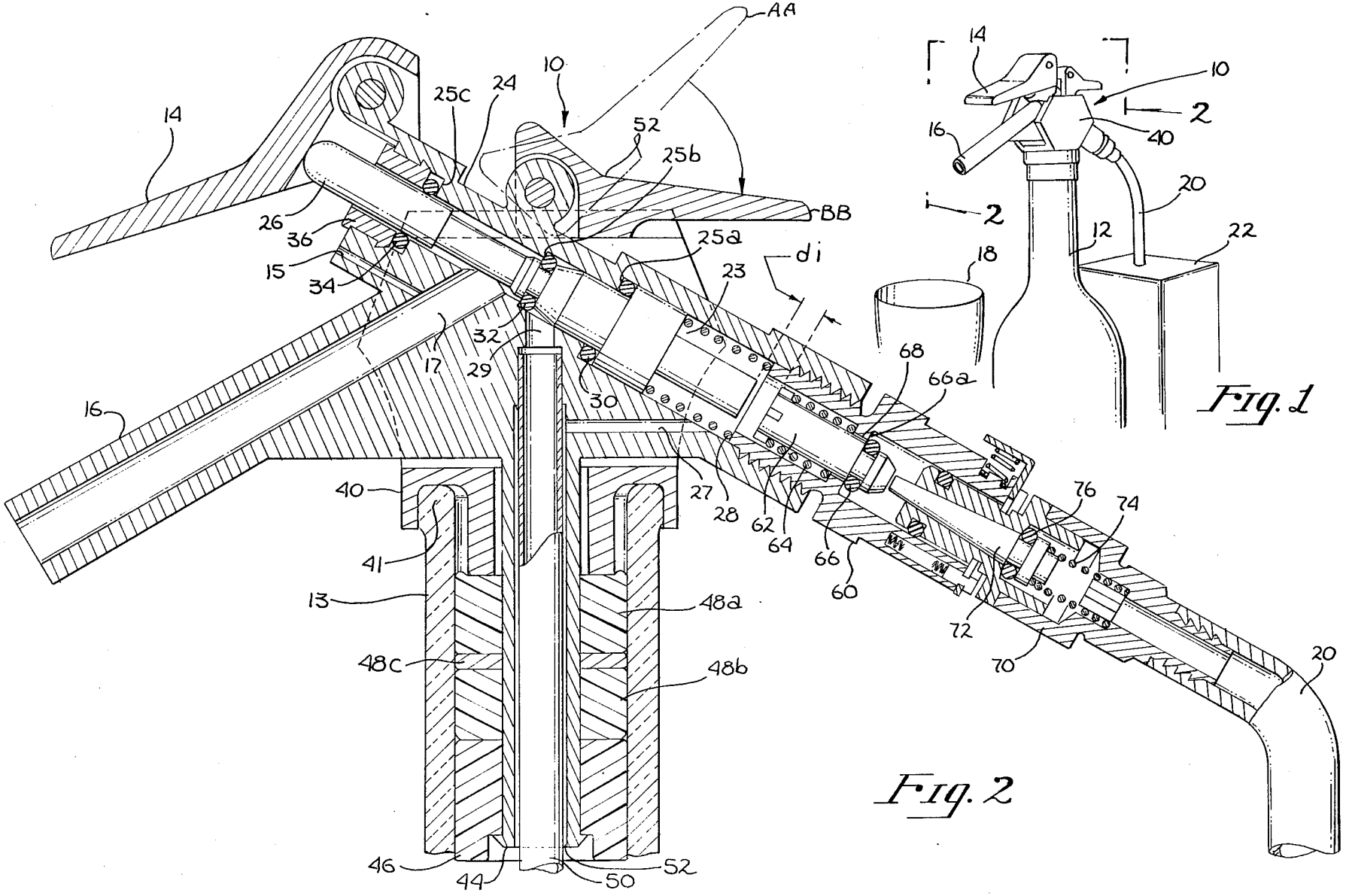
FIG. 1 is a perspective view of the preferred embodiment of the present invention.
FIG. 2 is a cross sectional view of the present invention illustrating the valve in a fully closed position.

FIG. 1 illustrates dispensing valve 10 in use with a wine bottle 12. Wine is dispensed through spout 16 into glass 18 by actuation of lever 14. A pressurized inert gas from source 22 is conveyed to dispensing valve 10 through supply tube 20. As will be subsequently described, actuation of lever 14 also controls admission of gas from source 22 into bottle 12 to displace wine within the bottle.

Figure 3:
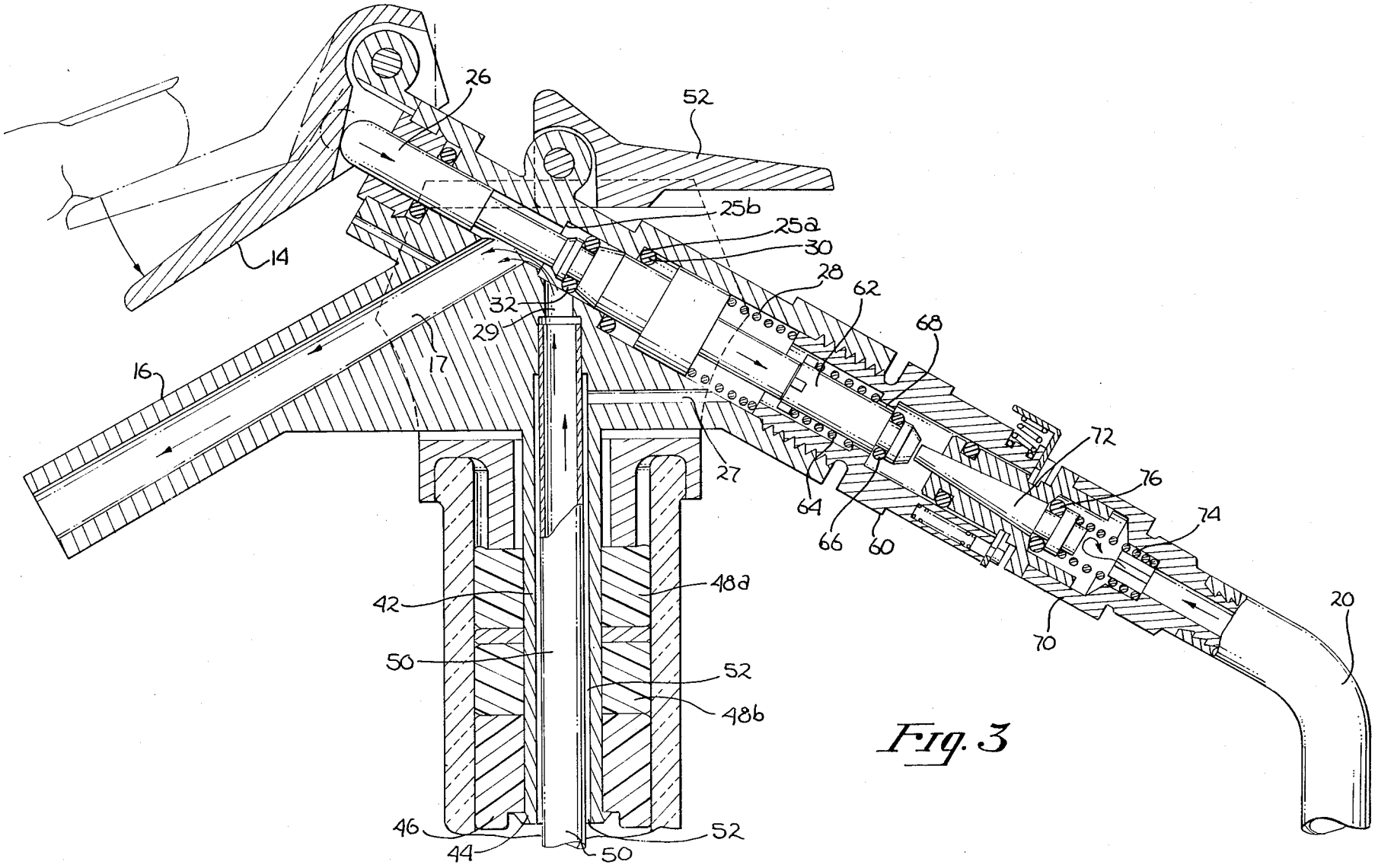
FIG. 3 is a cross sectional view of the present invention illustrating the liquid section of the valve in an open position.
Figure 4:
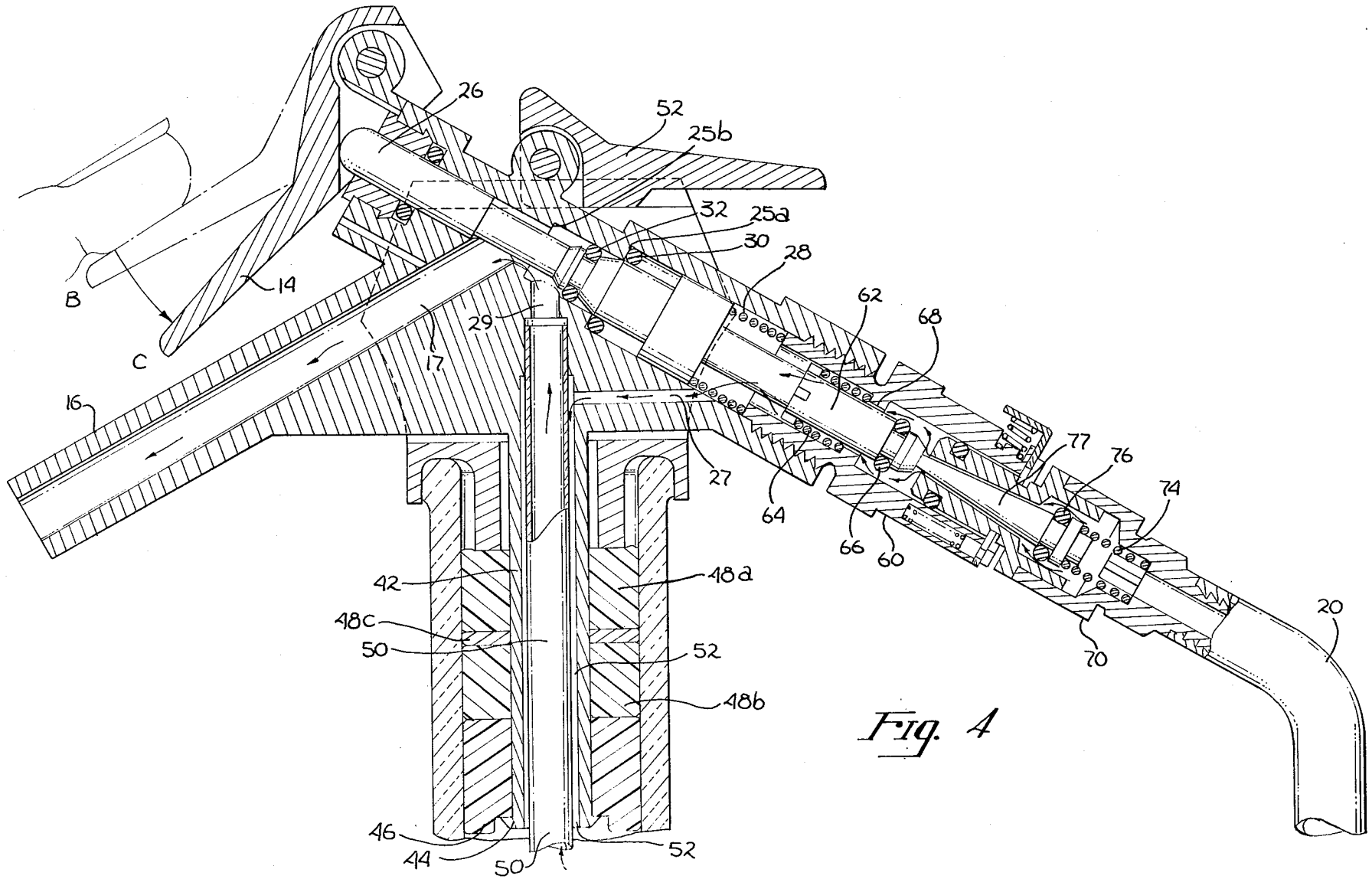
FIG. 4 is a cross sectional view of the present invention illustrating both the liquid and gas sections of the valve in an open position.

FIGS. 2–4 illustrate the detailed operation of dispensing valve 10. Valve body 24 includes a primary cavity 23 comprising a plurality of coaxial cylindrical sections. Valve slide 26 is disposed within valve body 24 and is biased to a closed position by spring 28, as illustrated in FIG. 2.

Liquid intake 29 and liquid outlet 17 communicate with cavity 23. When valve slide 26 is in the fully closed position illustrated in FIG. 2, liquid intake 29 is closed off by O-rings 30 and 32 which are pressed against seats **25*a* and 25*b* respectively by the force of spring 28**.

Valve slide 26 projects from valve body 24 and is acted upon by lever 14. O-ring 34 acts against seat **25*c* and is held in place by retainer 36 to seal the opening of valve body 24 through which valve slide 26** extends.

Valve body 24 incorporates spout 16 through which liquid is dispensed. Drainage of liquid from liquid outlet 17 within spout 16 is assured by vent 15. Vent 15 is drilled through valve body 24 allowing air to enter the upper end of liquid outlet 17, thereby preventing creation of a vacuum upon closure of valve slide 26.

Valve body 24 is positioned within saddle shaped bottle cap 40. Stem 42 of valve body 24 extends downwardly through bottle cap 40 into bottle 12. Intake tube 50 extends from liquid inlet 29 downwardly through stem 42 into bottle 12. Tube 50 is preferably made of stainless steel, Teflon or other appropriate material, and is preferably adjustable in length so that it can accommodate bottles of differing sizes and can be positioned with respect to the bottom of the bottle so as to preclude pick up of sediment which may have accumulated at the bottom of the bottle.

Stem 42 has a flange 44 at the lower end thereof. Washer 46 and seals 48*a* and 48*b* and washer 48*c* are retained between flange 44 and bottle cap 40. Washer 48*c* separates and helps position seals 48*a* and *b*. Bottle cap 40 includes annular recess 41 which accommodates neck 13 of bottle 12. The outside diameter of seals 48*a* and 48*b* and washer 48*c* is preferably slightly smaller than the inside diameter of a neck of a standard wine bottle, or approximately 0.66 inches. Dispensing valve 10 is secured to wine bottle 12 by inserting the assembly consisting of stem 42, intake tube 50, washer 46, and seals 48*a* and 48*b* and washer 48*c* into neck 13 of bottle 12 until bottle cap 40 rests against the lip of bottle neck 13. Lever 52, which is hingedly attached to the upper portion of valve body 24, is then lowered from the position labeled AA in FIG. 2 to position BB. Lowering of lever 52 exerts a camming action against the upper surface of bottle cap 40, thereby compressing seals 48*a* and 48*b* in a vertical direction. Such compression of seals 48*a* and 48*b* tends to increase their outside diameters, thereby sealing neck 13 of bottle 12 and locking dispensing valve 10 in place.

One or both of seals 48*a* and 48*b* are preferably made of a suitably compliant material such as butadiene (nitrile). In the preferred embodiment, one such seal has a type "A" durometer Shore hardness value of 40+/−5, whereas the other has a hardness value of 55+/−5.

As previously explained, dispensing valve 10 is maintained in a normally closed condition by spring 28 acting against valve slide 26 to force O-rings 30 and 32 against seats 25*a* and 25*b* respectively. Dispensing valve 10 is operated by depressing lever 14 which acts against valve slide 26 to compress spring 28. Partial actuation of dispensing valve 10 is illustrated in FIG. 3, wherein lever 14 has been depressed from its normal position A (shown in phantom) to position B. Such movement of lever 14 causes valve slide 26 to move longitudinally within valve body 24 compressing spring 28 and closing gap d1 between valve slide 26 and coupling insert 62. Such movement of valve slide 26 causes O-ring 32 to retract from seat 25*b* and allows communication between liquid inlet 29 and liquid outlet 17. In the event that there is residual pressure within bottle 12, liquid will be forced up tube 50, into inlet 29, and out outlet 17. Liquid flow is prevented from escaping valve body 24 through other than liquid outlet 17 by O-rings 30 and 34.

Further depression of lever 14 causes valve slide 26 to act upon insert 62 which is biased in a normally closed position by spring 64 as shown in FIGS. 2 and 3. Movement of insert 62 away from its normally closed position releases O-ring 66 from contact with annular gap 68. The dimensions of insert 62 and female coupling 60 are preferably such that annular gap 68 is approximately 0.002 to 0.007 inches.

Continued depression of lever 14, such as from position B to position C as shown in FIG. 4, causes insert 62 to come into contact with throttling pin 72. Throttling pin 72 is biased to a closed position by spring 74. O-ring 76 prevents the escape of pressurized gas entering through tube 20 past throttling pin 72. As throttling pin 72 is opened, pressurized gas from supply 22 is allowed to flow through tube 20, through annular gap 68, and into valve body 24. Orifice 27 permits gas entering valve body 24 to flow into gap 52 between stem 42 and intake tube 50. Pressurized gas is thus permitted to flow into bottle 12, thereby forcing liquid up through intake tube 50 and out through liquid outlet 17 at a variable rate based on the degree of depression of throttling pin 72.

It is to be noted that actuation of lever 14 allows liquid to flow prior to the introduction of pressurized gas into bottle 12. Similarly, release of lever 14 closes the supply of pressurized gas into bottle 12 prior to closure of the liquid path. This sequential actuation of the liquid and gas sections of dispensing valve 10 assures that excess gas pressure cannot accumulate in bottle 12. Further, minimum gas pressure is kept in the bottle and thus in the wine. This reduces the forced introduction of the inert gas into the wine and thereby keeps the wine in its most favorable condition.

It is to be noted that insert 62 is normally kept in a closed position with O-Ring 66 sealing against seat 66*a*. Gas cannot escape or enter into wine bottle 12 until valve slide 26 actuates insert 62. A further feature of insert 62 is that any build up of excess gas pressure against insert 62 continues to tighten the seal of O-ring 66. This provides an additional means for preventing unwanted gas pressure from building up in wine bottle 12.

In a similar fashion, male coupling 70 has a built in safety feature by which throttling pin 72 is further tightened against O-ring 76 by additional gas pressure entering from gas source 22 through supply tube 20.

Dispensing valve 10 may be conveniently connected and disconnected from supply tube 20 by means of a quick disconnect coupling comprising female member 60 and male member 70. Details of the operation of coupling members 60 and 70 are illustrated in FIGS. 5–7.

Figure 5:
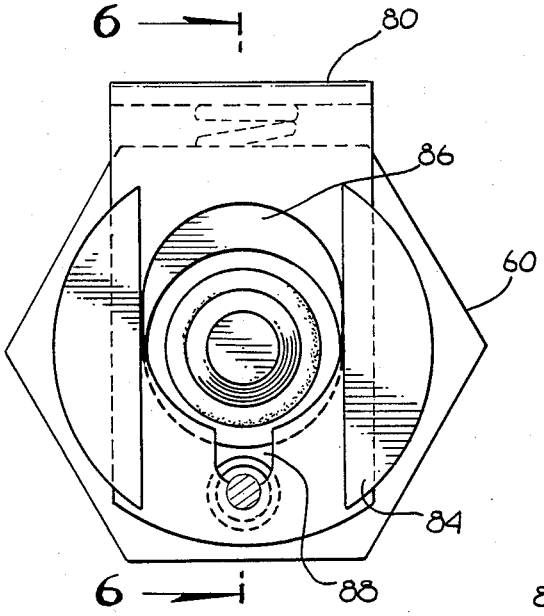
FIG. 5 is a cross sectional view of the coupling of the present invention taken along line of 5—5 of FIG. 4.
Figure 6:
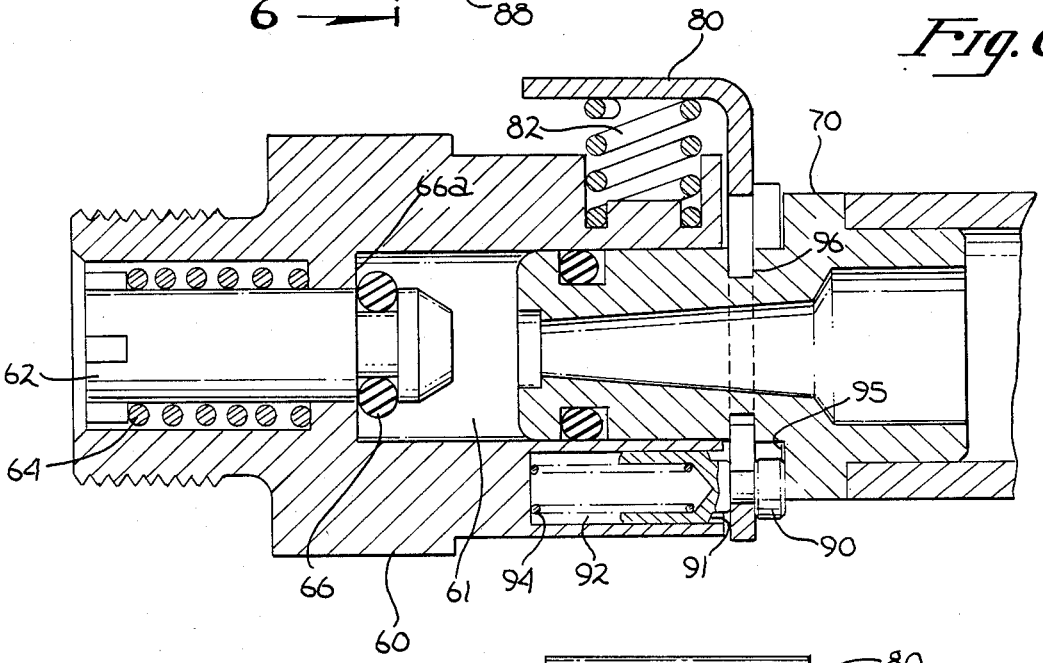
FIG. 6 is a cross sectional view of the coupling of the present invention taken along line 6—6 of FIG. 5.
Figure 7:
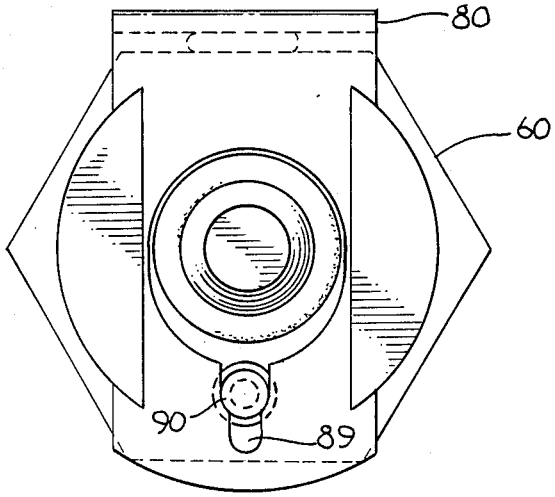
FIG. 7 is an end view of the female coupling of the present invention illustrating the coupling in a disconnected configuration.

FIGS. 5 and 6 illustrate the coupling in a locked configuration. Locking plate 80 is biased to an upward position by spring 82. Locking plate 80 is free to move vertically within slots 84 of male coupling 60. Locking plate 80 includes aperture 86 through which male coupling 70 may be inserted. In the locked configuration illustrated in FIGS. 5 and 6, locking plate 80 penetrates groove 96 of male coupling 70 at the lower portion of the circumference of aperture 86, thereby preventing relative longitudinal motion between coupling members 60 and 70. Locking plate 80 further includes apertures 88 and 89, through which release pin 90 extends. Release pin 90 resides within cavity 92 of female coupling 60 and is biased in an outwardly direction by spring 94.

In order to disconnect coupling members 60 and 70, locking plate 80 is depressed against the force of spring 82. When locking plate 80 is depressed to the position illustrated in FIG. 7, release pin 90 is forced outward by spring 94 until shoulder 91 strikes locking plate 80. Locking plate 80 is then prevented from returning to its locked position due to the presence of pin 90 within aperture 88. While moving outwardly, pin 90 bears against surface 95 of male coupling 70, thereby urging it to withdraw from female coupling 60, and providing sufficient clearance for shoulder 91 of pin 90 to engage locking plate 80 as described above. Coupling members 60 and 70 may then be fully separated.

Connection of coupling members 60 and 70 proceeds by first inserting male coupling 70 through aperture 86 of locking plate 80 into receptacle 61 of female coupling 60. As male coupling 70 is thus inserted, surface 95 contacts release pin 90, pushing it inward against the force of spring 94 until pin 90 retracts sufficiently for locking plate 80 to be released and urged upward by spring 82 until pin 90 rests within aperture 89. Locking plate 80 thus engages groove 96 as described above, to lock male coupling 70 in place within female coupling 60.

It will be recognized that the above-described invention may be embodied in other specific forms without departing from the spirit or essential characteristics of this disclosure. Thus, it is understood that the invention is not to be limited by the foregoing illustrative details, except as set forth in the appended claims.

I claim:

1. A liquid dispensing valve comprising:

a valve body having a cavity including a plurality of generally cylindrical coaxial sections;

a valve slide disposed within and extending through said cavity and longitudinally movable therewithin;

spring means operably coupled to said valve slide for biasing said valve slide to a first longitudinal position;

liquid inlet means disposed within said valve body and communicating with said cavity for receiving a liquid;

liquid outlet means disposed within said valve body and communicating with said cavity for dispensing said liquid;

seal means disposed between said valve slide and an inner surface of said cavity for preventing communication between said liquid inlet means and said liquid outlet means when said valve slide is in said first longitudinal position and for allowing said liquid inlet means to communicate with said liquid outlet means through said cavity when said valve slide is moved to a second and a third longitudinal position;

a female coupling attached to said valve body;

a male coupling connected to a source of pressurized gas and operably engageable with said female coupling;

locking means for locking said male and female coupling together upon engagement; and gas admitting means disposed within said male and female couplings and actuatable by said valve slide for selectively admitting said pressurized gas into said valve body when said valve slide is moved to said third longitudinal position which is more distant from said first longitudinal position than said second longitudinal position;

wherein said gas admitting means comprises:

a cylindrical insert disposed within said female coupling and longitudinally movable therewithin and defining an annular passage between an outer surface of said insert and an inner surface of said female coupling;

an insert spring disposed within said female coupling and acting against said insert to bias it in a closed position;

a first O-ring disposed in said insert for sealing said annular passage when said insert is in said closed position;

a generally conical throttling valve disposed within said male coupling and longitudinally movable therewithin, said male coupling having a generally mating conical bore;

a throttling valve spring disposed within said male coupling and acting against said throttling valve to bias it in a closed position;

a second O-ring disposed in said throttling valve for sealing said conical bore when said throttling valve is in said closed position;

said insert and said throttling valve disposed when said male and female couplings are fully engaged such that longitudinal movement of said insert away from said closed position is proximately imparted to said throttling valve;

whereby longitudinal movement of said insert away from said closed position opens said throttling valve and admits the pressurized gas through said annular passage.

2. The liquid dispensing valve of claim 1 further comprising lever means operably coupled to said valve slide for causing said valve slide to move longitudinally within said cavity between said first, second and third longitudinal positions.

3. The liquid dispensing valve of claim 1 further comprising bottle stopper means coupled to said valve body for attaching said liquid dispensing valve to a bottle containing a liquid to be dispensed and for sealing an opening of the bottle.

4. The liquid dispensing valve of claim 3 wherein said bottle stopper means comprises:

a generally cylindrical stem coupled to said valve body and adapted to be disposed within a neck of a bottle;

a bottle cap adapted to cover the opening of the bottle, said bottle cap having an upper surface, a lower surface and an aperture through which said stem of said valve body extends downwardly into said neck of the bottle;

a compliant annular bottle seal sleeve disposed around said stem and within the neck of the bottle and having an upper surface in contact with a lower surface of said bottle cap; and camming means coupled to said valve body and operable against an upper surface of said bottle cap for axially compressing said bottle seal sleeve;

whereby actuation of said camming means causes said bottle seal sleeve to expand radially and contact said inner surface of the neck of the bottle, thereby securing said liquid dispensing valve to the bottle and sealing the opening of the bottle.

5. The liquid dispensing valve of claim 4 further comprising an intake tube coupled to said liquid inlet means extending downwardly into the bottle.

6. The liquid dispensing valve of claim 1 wherein said locking means comprises:

a locking plate coupled to said female coupling having an aperture through which said male coupling is inserted into said female coupling;

said male coupling having an annular notch within an outer cylindrical surface thereof;

spring means for causing said locking plate to engage said annular notch of said male coupling when said male and female couplings are fully engaged; and pin means engageable with said locking plate for retaining said locking plate in an unlocked position for engagement and disengagement of said male and female couplings, said pin means retracting upon full engagement of said male and female couplings to release said locking plate from said unlocked position.

* * * * *